United States Patent [19]

Jeffrey et al.

[11] Patent Number: 4,637,842

[45] Date of Patent: Jan. 20, 1987

[54] PRODUCTION OF ALUMINUM ALLOY SHEET AND ARTICLES FABRICATED THEREFROM

[75] Inventors: Paul W. Jeffrey; Gilles Marchand, both of Kingston, Canada

[73] Assignee: Alcan International Limited, Montreal, Canada

[21] Appl. No.: 588,945

[22] Filed: Mar. 13, 1984

[51] Int. Cl.[4] ..... C22F 1/04

[52] U.S. Cl. ..... 148/12.7 A; 148/415; 148/417

[58] Field of Search ..... 148/12.7 A, 415, 417

[56] References Cited

U.S. PATENT DOCUMENTS 4,174,232 11/1979 Lenz et al. ..... 148/12.7 A

FOREIGN PATENT DOCUMENTS 0097319 1/1984 European Pat. Off. .
52-94817 8/1977 Japan .
52-105509 9/1977 Japan .
57-149459 9/1982 Japan .
856182 12/1960 United Kingdom .
1593899 7/1981 United Kingdom .

OTHER PUBLICATIONS

Aluminum Association, "Aluminum Standards and Data 1979," pp. 53–54.

Aluminum Association, "Tempers for Aluminum and Aluminum Alloy Products," pp. 12, 13 and 27 (1981).

*Aluminum,* vol. 1, ASM (1967 Ed.), pp. 198 and 326.

Bridgeport Brass Co./Alcan Aluminum Corp., internal communications, 6 pages (unpublished: dated 1964 and 1967).

Giarda et al., "Indagini su Leghe Al-0.8% $Mg_2Si$ a Tenori Variabili di Si in Eccesso . . . ," *Alluminio,* Jul.–Aug. 1976, pp. 387–399 (with abstract and translation).

Rack et al., "Thermomechanical Treatment of High Purity 6061 Aluminum," 8A *Metallurgical Translations,* 335–346 (1977).

Benedyk, "Thermomechanical Treatment of Precipitation Hardening Aluminum Alloys," *Light Metal Age,* Apr. 1968, pp. 10 and 12.

Stheyunberg et al., "Low Temperature Thermomechanical Treatment . . . ," *Light Metal Age,* Aug. 1974, pp. 13–15.

Rack et al., "Thermomechanical Treatment of 6000 Aluminum Alloys," Pub. TMS/AIME, pp. 86–89 and 104 (no date; ca. 1978; with abstract).

Kaneko, 27 *J. Japan. Inst. of Light Metals,* No. 2, pp. 49–56 (no date; ca. 1976).

Leymarie, "Aluminium Alloys and the Can Industry," preprint from The Effective and Economic Use of the Special Characteristics of Aluminum and its Alloys, Institute of Metals Conference (1972), pp. 229–232.

*Primary Examiner*—R. Dean

*Attorney, Agent, or Firm*—Cooper, Dunham, Griffin & Moran

[57] ABSTRACT

A process for producing Al-Mg-Si alloy sheet in T8 temper, including the steps of providing a sheet article of an intermediate gauge, solution heat treating the article, naturally aging the article for at least one day, cold rolling the article to final gauge, and artificially aging it, wherein the artificial aging step is performed by heating the cold rolled sheet at final gauge to a predetermined temperature for a time shorter than that at which maximum yield strength would be achieved. The intermediate gauge is selected such that a reduction between about 25% and about 71% therefrom is required to achieve the final gauge. The T8 sheet is characterized by strength and formability properties suitable for production of one piece drawn and ironed can bodies and lids therefor, and for other purposes.

16 Claims, 4 Drawing Figures

PRODUCTION OF ALUMINUM ALLOY SHEET AND ARTICLES FABRICATED THEREFROM

BACKGROUND OF THE INVENTION

This invention relates to processes for producing Al-Mg-Si alloy sheet and articles fabricated therefrom, and to the products of such processes.

Al-Mg-Si alloys as herein contemplated are alloys having a major content of Al and a minor content of Mg and Si, and are exemplified by known alloys identified by Aluminum Association designations in the 6000 series, e.g. the alloys having Aluminum Association (AA) designations 6009, 6010, 6011, 6061, and 6063. The term "sheet" is broadly used herein to mean rolled products, without limitation to any particular gauge; thus it includes products at plate and foil gauges as well as products at conventional sheet gauges.

More particularly, the invention is directed to processes for producing Al-Mg-Si sheet in so-called T8 temper, which is the temper achieved by performing successively the steps of solution heat treatment, quenching, cold working, and artificial aging, sometimes with a natural aging period interposed between the quench after solution heat treatment and the following cold working step. It has heretofore been known to provide Al-Mg-Si products, including sheet, in T8 temper, for various purposes.

In one important specific aspect, to which detailed reference will be made herein for purposes of illustration, the invention is directed to the production of aluminum alloy can body and lid stock, viz. aluminum alloy sheet for forming one-piece drawn and ironed can bodies and can lids for such bodies, as well as to the formation of can bodies and lids from such sheet and to the articles thus formed.

Present-day metal cans as used for beverages such as soft drinks, beer and the like are commonly constituted of a seamless one-piece body (which includes the bottom end and cylindrical side wall of the can) and a top end bearing a ring or other opening device. The body is produced from a blank of cold-rolled aluminum alloy sheet (having a gauge, for example, of about 0.014 inch) by a now-conventional forming technique known as drawing and ironing, which involves drawing the blank into a cup and then passing it through a succession of dies to achieve the desired elongated cylindrical body configuration, with a side wall of reduced thickness relative to the bottom end. The top end is separately produced from another sheet aluminum alloy blank, by different but also conventional forming operations, and is secured around its circumference to the top edge of the side wall of the body to provide a complete can.

The severity of the forming procedure employed in producing a drawn-and-ironed can body as described above, and in particular the reduction in thickness of the can side wall (which must nevertheless be able to withstand the internal and external forces exerted on it in use), as well as the fact that the formed can is usually lacquered in an operation necessitating a strength-reducing exposure to heat, require a special combination of strength, formability, and tool wear properties in the alloy sheet from which the can body is made. Significant among these properties are ultimate tensile strength, yield strength, elongation, and earing. Attainment of the requisite combination of properties is dependent on alloy composition and on the processing conditions used to produce the sheet.

Heretofore, a conventional sheet for can body blanks has been constituted of the alloy having the Aluminum Association designation AA3004, and has been produced from conventionally direct-chill-cast ingot up to 24 inches thick by scalping and homogenizing the ingot, and successively hot rolling and cold rolling to the desired final gauge; often an anneal treatment is used between the hot and cold rolling operations, with the annealing gauge so selected that the amount of cold reduction to final gauge after annealing is about 85%, thereby to provide can body blanks in H19 (extra hard) temper. This practice imparts the combination of properties currently required for commercial can body stock. The aluminum alloy designated AA 5182 is extensively used for the manufacture of the can top ends or lids, can lid stock (sheet) of such alloy being produced in a manner similar to that described above for production of AA3004 can body stock in that similar steps of direct chill casting, homogenization, hot rolling, annealing and cold rolling to the H19 temper are employed; cold rolling may also be performed between the hot rolling and annealing steps. The final can lid stock, e.g. at a gauge of about 0.013 inch, is lacquered and then formed into lids,the lacquering operation again involving a stoving (heating) step.

Although satisfactory cans are provided by the foregoing conventional procedures utilizing different alloys for the body and lid respectively, it would be desirable to produce cans having both body and lid formed of the same alloy, to facilitate recovery and reuse of the metal when the cans are recycled. Such an alloy requires a combination of highstrength and good formability. Aluminum alloy sheet having such a combination of strength and formability properties would be advantageous for use, at various gauges, in a wide variety of other applications as well.

SUMMARY OF THE INVENTION

The present invention broadly contemplates the provision of a process for producing aluminum alloy sheet of predetermined final gauge, comprising the steps of providing a sheet article of a heat-treatable Al-Mg-Si alloy (having a composition as defined below) at an intermediate gauge from which a reduction of between about 25% and about 71% is required to achieve the predetermined final gauge; solution-heat-treating the sheet article at the intermediate gauge by heating and quenching, for effecting at least substantially complete solution of the Mg and Si therein; after quenching, and without intervening heat treatment, naturally aging the sheet article by maintaining it at ambient temperature for at least about one day; after natural aging, and without intervening heat treatment, cold rolling the sheet article to the final gauge (i.e. with a reduction of between about 25% and about 71%); and artificially aging the sheet article at the final gauge for increasing the yield strength thereof by heating the article to a predetermined temperature for a time shorter than that required to achieve the maximum yield strength attainable by artificial aging of the article at that predetermined temperature, and such that the % elongation value of the article after artificial aging is within 20% of the maximum value attainable by artificial aging of the sheet article at that temperature following the same extent of cold reduction performed after solution heat treatment. The alloys used in the process, in its broadest aspects, are those having a major content of Al and a minor content of Mg and available Si such that on a rectangular graph of % Mg plotted against % available Si, the point representing the Mg and available Si content lies within the area of a pentagon defined by the coordinates 0.2% Si, 0.4% Mg; 0.2% Si, 0.9% Mg; 0.4% Si, 1.2% Mg; 1.2% Si, 1.2% Si, 0.4% Mg, all composition percentages here and elsewhere set forth in the present specification being expressed as percentages by weight. As used herein, the term "available Si" means Si which has not been taken up by Fe, which is ordinarily present in the alloy. It is usual to assume that a percentage of Si equal to one third of the Fe content is lost to the intermetallic compounds. Thus, with this assumption made, the available Si content of an alloy (in weight percent) is equal to the total Si content of the alloy (in weight percent) less one-third of the Fe content (in weight percent).

The process of the invention differs from procedures heretofore known (for producing Al-Mg-Si articles in T8 temper) in that, in the artificial aging step, heating is terminated before the article attains its maximum yield strength. Specifically, it has now been found that when a solution-heat-treated and workhardened Al-Mg-Si sheet is heated to effect artificial aging, the formability (represented by % elongation) as well as the yield strength initially increases, although with continued heating, the % elongation begins to decrease at a time when the yield strength is still increasing. Thus, termination of artificial aging before the peak yield strength is reached affords beneficial improvement in strength without substantial impairment of formability, and indeed, in many cases, with actual enhancement of formability.

More particularly, the steps of natural aging after solution heat treatment, subsequent cold rolling between about 25% and about 71%, and artificial aging with observance of the special conditions just described, cooperatively provide artificially aged sheet having a superior combination of strength and formability properties. In one specific sense, the process of the invention further includes the step of forming the artificially aged sheet article into a component of a can, viz. a one-piece drawn and ironed can body having an open end or a lid for closing the open end. In some instances, the stoving (heating) operation performed after lacquering of the lid stock may be conducted under conditions selected to constitute the artificial aging step of the present process, although it is at present preferred to perform the artificial aging on the sheet stock prior to lacquering. As will be understood, in these embodiments of the process of the invention, the predetermined final gauge to which the sheet is reduced before artificial aging is a desired and e.g. conventional gauge for can body or lid stock. Advantageously, the invention can be embodied in a process for the production of cans wherein both lid and body are fabricated of sheet of the same alloy produced by the foregoing sequence of steps so that the metal of the can (when recycled) may be remelted and reused to produce new can bodies and lids without major adjustment of alloy composition.

In a broader sense, the sheet products of the invention may be produced at various final gauges, since the combination of strength and formability achieved by the present process is beneficial for diverse uses. A preferred upper limit of final sheet gauge for products of the present process is ½ inch.

Preferably, the alloy composition employed in the practice of the invention is selected to have at least a slight excess of available Si over that stoichiometrically required for combination (as $Mg_2Si$) with all the Mg present, and (especially for production of can body or lid stock) the amount of Mg in the alloy is selected to insure a total $Mg_2Si$ content between about 1.35 and about 1.50%. Preferably also, the amount of cold reduction between solution heat treatment and artificial aging is at least about 35%, and most preferably (again, for production of can body and lid stock) the amount of such cold reduction is between about 50 and about 71%, this condition being provided by appropriate selection of the aforementioned intermediate gauge with reference to the desired predetermined final gauge.

The invention also embraces sheet articles, and can components, produced by the foregoing process, and possessing the advantageous combination of mechanical properties thereby achieved.

Further features and advantages of the invention will be apparent from the detailed description hereinbelow set forth, together with the accompanying drawings.

DETAILED DESCRIPTION

The invention will be described, with reference to the drawings, as embodied in a process for producing Al-Mg-Si alloy sheet from reroll stock by the successive steps of providing a sheet article of intermediate gauge, solution heat treating, natural aging, cold rolling, and artificial aging, and in the products of that process. Particulars of the alloys employed, the preparation of the reroll stock, the performance of each of the aforementioned steps, and their combination in the complete process, are set forth below.

Alloy Composition

Figure 1:
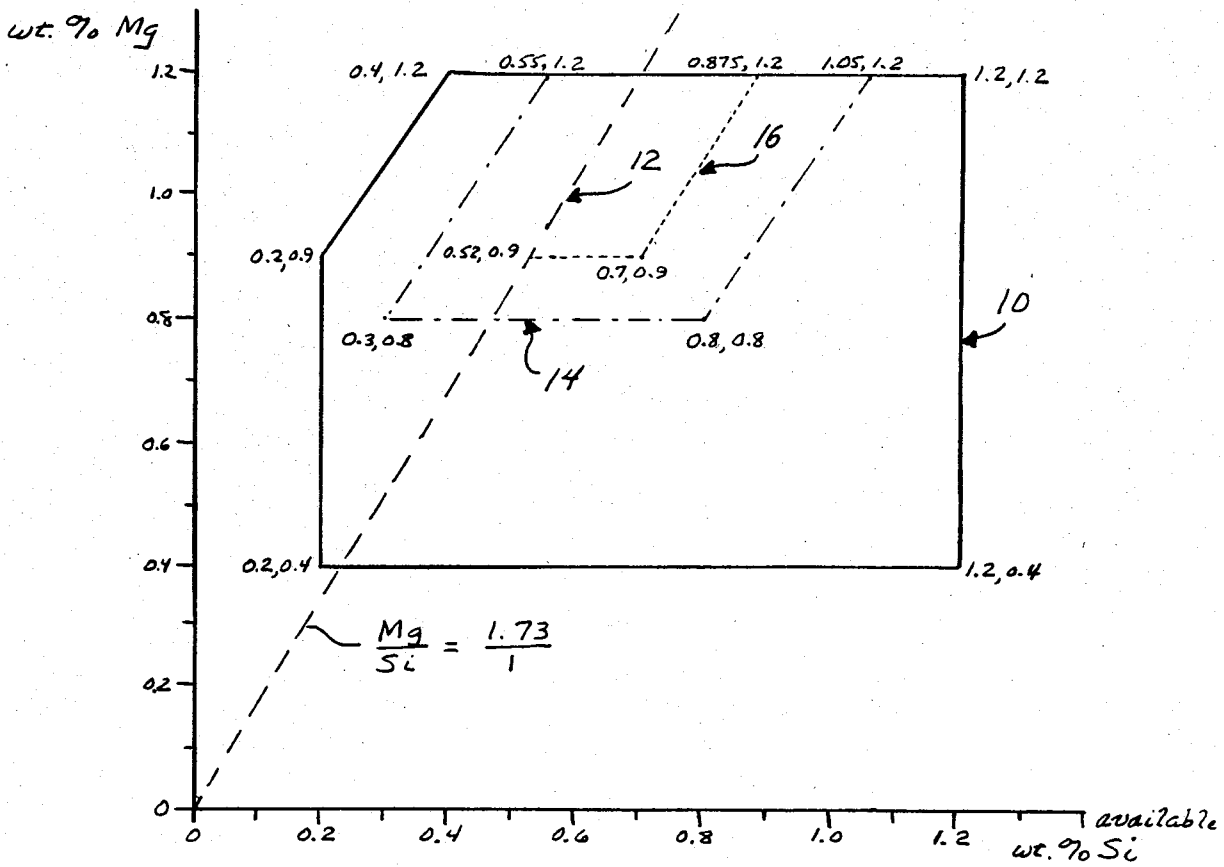
FIG. 1 is a rectangular graph on which % Mg is plotted against % available Si, in illustration of the Mg and available Si content of alloys suitable for the practice of the present invention.

Alloys suitable for the praotice of the present invention broadly include Al-Mg-Si alloys having a minor content of Mg and available Si such that on a rectangular graph of % Mg plotted against % available Si (i.e. the graph of FIG. 1) the point representing the Mg and available Si content of the alloy lies within the area of pentagon 10 in FIG. 1, viz. a pentagon defined by the coordinates 0.2% Si, 0.4% Mg; 0.2% Si, 0.9% Mg; 0.4% Si, 1.2% Mg; 1.2% Si, 1.2% Mg; and 1.2% Si, 0.4% Mg. Preferred alloy compositions, within this broad definition, are those for which the point representing Mg and available Si content lies not only within the aforesaid pentagon but also to the right of a line 12 which represents the theoretical $Mg_2Si$ weight ratio, i.e. Mg/Si=1.73/1. Preferably, also, the alloy consists essentially of Mg and available Si in amounts (%) defined by pentagon 10, optionally also containing up to 0.9% Cu, up to 1.0% Fe, up to 0.8% Mn, up to 0.35% Cr, up to 0.25% Zn, up to 0.20% Ti, balance essentially Al with usual impurity levels not materially affecting the combination of strength and formability properties with which the present invention is concerned.

Specific examples of known alloys within the foregoing broad definition, and suitable for the practice of the invention, are the alloys having the Aluminum Association designations AA 6009, 6010, 6011, 6061, and 6063, the registered compositions of which are as follows:

| | Range or Maximum (% by weight) | | | | |
|---|---|---|---|---|---|
| | AA6009 | AA6010 | AA6061 | AA6063 | AA6011 |
| Si | 0.6–1.0 | 0.8–1.2 | 0.40–0.8 | 0.20–0.6 | 0.6–1.2 |
| Fe | 0.50 | 0.50 | 0.7 | 0.35 | 1.0 |
| Cu | 0.15–0.6 | 0.15–0.6 | 0.15–0.40 | 0.10 | 0.40–0.9 |
| Mn | 0.20–0.8 | 0.20–0.8 | 0.15 | 0.10 | 0.8 |
| Mg | 0.40–0.8 | 0.6–1.0 | 0.8–1.2 | 0.45–0.9 | 0.6–1.2 |
| Cr | 0.10 | 0.10 | 0.04–0.35 | 0.10 | 0.30 |
| Zn | 0.25 | 0.25 | 0.25 | 0.10 | 1.5 |
| Ti | 0.10 | 0.10 | 0.15 | 0.10 | 0.20 |
| Ni | — | — | — | — | 0.20 |
| other (each/total) | 0.05/0.15 | 0.05/0.15 | 0.05/0.15 | 0.15/0.15 | 0.05/0.15 |
| Al | balance | balance | balance | balance | balance |

Alloys with the composition limits of AA6061 as given above are particularly preferred, especially for embodiments of the invention providing drawn-and-ironedcan body stock and can lid stock; currently most preferred for these embodiments is an alloy having the nominal composition 0.25% Fe, 0.30% Cu, 0.65% Si, 0.05% (max.) Mn, 0.90% Mg, 0.05%(max.) Zn, 0.17% Cr, 0.25% (max.) Ti, others 0.10% (max.), balance aluminum, the designation "(max.)" being used to indicate that the value given is a maximum and that the element so designated is merely optional or tolerable as an impurity up to the stated maximum. For good age-hardening response, the alloy should contain a slight excess of available Si (at least about 0.05%) over that needed to stoichiometrically form Mg2Si with a weight ratio (Mg/Si) of 1.73/1; as mentioned above, when making this calculation, it is usual to assume that a percentage of the total Si content equal to ⅓ of the Fe content is lost to the intermetallic compounds. It is also usual with AA6061 to ensure a total $Mg_2Si$ content between about 1.35 and about 1.50.

A further example of alloys suitable for can stock are those having a minor content of Mg and available Si such that on the graph of FIG. 1, the point representing the Mg and available Si content of the alloy lies within the area of a parallelogram defined by the coordinates 0.3% Si, 0.8% Mg; 0.55% Si, 1.2% Mg; 1.05% Si, 1.2% Mg; and 0.8% Si, 0.8% Mg, this parallelogram being represented in FIG. 1 by the chain lines 14 and a portion of the top (horizontal) line of pentagon 10. Preferred alloy compositions within this parallelogram are those for which the point representing Mg and available Si content lies to the right of the aforementioned line 12; of these, the most preferred compositions are those (again within the parallelogram) for which the point representing Mg and available Si content lies above and to the left of the dotted lines 16 and to the right of line 12, i.e. within the quadrilateral defined by the coordinates 0.7% Si, 0.9% Mg; 0.875% Si, 1.2% Mg; 0.69% Si, 1.2% Mg; 0.52% Si, 0.9% Mg.

Preparation of Reroll Stock

The starting material for the practice of the present process, in illustrative embodiments thereof, is a body of an alloy having a composition as defined above, in the form of a strip of appropriate gauge for the initial cold-rolling step of the process, such strip being herein termed "reroll stock." Typically, the reroll stock is prepared by casting a conventionally dimensioned sheet ingot of the alloy, e.g. by socalled direct chill casting, scalping and homogenizing the ingot, and hot rolling to the reroll gauge, all in accordance with well-known and wholly conventional procedures. Alternatively, the reroll stock can be produced by continuous strip casting techniques, viz. by casting the alloy as a continuous, relatively thin strip in a casting cavity defined between chilled endless moving steel belts, between chilled rolls, or between chilled walls of a stationary mold, again as is well-known in the art. Such continuously cast strip either can be cast sufficiently thin to enable direct cold rolling, or can be hot-rolled to reroll gauge. The reroll stock, however produced, is cooled and ordinarily coiled; thus, preferably in at least most instances, the reroll gauge is sufficiently thin to enable direct coiling.

Provision of Intermediate Gauge Sheet Article

In specific exemplary embodiments of the invention, reroll stock prepared as described above is cold rolled (employing procedure entirely conventional for cold rolling of Al-Mg-Si alloys) to reduce it to strip of an intermediate gauge at which the strip is to be solution heat treated. This intermediate or solution-heat-treatment gauge is selected, with reference to the predetermined desired final gauge of the sheet to be produced, such that a reduction of between about 25% and about 71% from the intermediate gauge is required to achieve the final gauge. That is to say, the intermediate gauge is selected to provide for further cold reduction of about 25% to about 71% by cold rolling after solution heat treatment, as described below; preferably, the amount of cold reduction after solution heat treatment is between about 35% and about 71% and indeed most preferably (especially for production of can body or can lid stock) between about 50% and about 71%, and for such preferred practice the intermediate gauge is selected accordingly. The reason for selecting the intermediate gauge to provide for the specified amount of cold reduction after solution heat treatment is to enable development of desired properties in the strip by post-solution-heat-treatment cold work. Selection of a particular intermediate gauge within the stated ranges is dependent on the specific properties sought to be attained in the final product.

It will be appreciated that the reroll gauge is not critical but is conveniently selected to be appropriately larger than the aforementioned intermediate daude, so that a substantial amount of reduction will be performed in the initial cold rolling step. Merely by way of illustration, in one example of production of can lid stock of 0.013 inch final gauge by the process of the invention, the intermediate (solution-heat-treatment) gauge is selected to be between 0.026 and 0.045 inch, such that the cold reduction to final gauge after solution heat treatment is between 50% and about 71%, depending upon the particular final properties desired; the reroll gauge in this instance is conveniently between about 0.120 inch and about 0.160 inch.

It will be also be appreciated that, in its broader aspects, the invention does not require that the sheet article be brought to intermediate gauge by cold rolling, but embraces the provision of the sheet article in intermediate gauge in other ways as well; for example, in some instances the intermediate gauge can be attained directly by hot rolling, without any cold rolling before solution heat treatment.

Solution Heat Treatment

The initially cold-rolled strip article, at the aforementioned intermediate gauge, is solution heat treated (by heating and quenching) under conditions selected to effect at least substantially complete solution of the Mg and Si therein. The steps and conditions employed may, again, be entirely conventional, and as such are well known to persons of ordinary skill in the art. Batch-type solution heat treatment may be used, although the time/temperature conditions are dependent on the coarseness of the $Mg_2Si$ phase, a batch process wherein the strip is heated for at 530° C. is completely satisfactory. Alternatively and preferably, continuous solution heat treatment of the intermediate gauge strip (e.g. performed on a continuous annealing line) may be employed, a high temperature being required in view of the short soaking time involved. For instance, in continuous solution heat treatment a peak metal temperature of 570° C., with a very short soak period of less than one minute, has been found adequate.

To retain the Mg and Si in solution, the metal must be rapidly cooled to room temperature (quenched) from the solution heat treatment temperature, viz. in a time of no more than 60 seconds, and preferably less than 30 seconds. If the intermediate gauge is sufficiently small, air quenching can be employed, but water quenching is necessary for heavier gauges and is suitable for all gauges.

Natural Aging

After solution heat treatment and quenching, and without any intervening subsequent heat treatment, the as-quenched strip article at the intermediate gauge is subjected to natural aging by standing at ambient temperature (e.g. about 0° to about 40° C.) for at least about one day, and preferably for at least about three days. Natural aging periods in excess of three days (regardless of how long) are also acceptable. The reason for performing this natural aging step, in the process of the invention, is to attain a state wherein the strength of the strip becomes relatively stable owing to the formation of lattice coherent nuclei of the $Mg_2Si$ phase.

Cold Rolling to Final Gauge

After natural aging, and again without any intervening heat treatment, the strip is subjected to cold rolling to effect work hardening while reducing it to the predetermined final gauge. The extent of cold reduction in this cold rolling step, in accordance with the invention, is between about 25% and about 71%, preferably at least about 35% and, as already stated, most preferably (especially for production of can body or lid stock) between about 50% and about 71%, the intermediate gauge being selected to provide for thisextent of cold reduction after solution heat treatment and natural aging. As before, the equipment and procedures employed to perform the cold reduction may be entirely conventional for cold rolling of aluminum alloy strip. This cold rolling operation after solution heat treatment produces a strip or sheet article which is at the final gauge and has been enhanced in strength by work hardening (the as-rolled final gauge sheet being in T3 temper), and which has not been subjected to any applied heat treatment following the quench from the solution heat treatment. Typical or exemplary final gauges are 0.013 inch for can lid stock and 0.014 inch for can body stock, or higher gauges (e.g. 0.040 inch) for other end products.

Between this step of cold rolling to final gauge and the subsequent artificial aging step described below, there is almost inevitably some further natural aging, since in the ordinary courseof commercial operation the cold-rolled strip article is not immediately artificially aged but sits for some period at ambient temperature. Such further natural aging, of whatever duration, is not material to the process of the invention.

Artificial Aging

Further in accordance with the invention, and as a particular feature thereof, the as-rolled strip at final gauge (usually, as noted, after some further incidental natural aging) is subjected to artificial aging, for increasing the yield strength thereof, by heating the strip to a predetermined elevated temperature for a time shorter than that required to achieve the maximum yield strength attainable by heating the same strip to the same temperature, and such that the elongation of the strip after artificial aging is within 20% of the maximum value attainable by heating the same strip to the same temperature. The expression "heating to," as used herein, will be understood to embrace both raising the strip to, and maintaining the strip at, the predetermined elevated temperature.

In this connection it may be explained that the yield strength and % elongation (as well as other properties) of Al-Mg-Si strip artificially aged from T3 temper are both dependent on time of heating to elevated temperature, for any given elevated temperature, in the artificial aging step. More particularly, it has now been found that during such heating, the % elongation (a measure of formability) as well as the yield strength initially increases to a maximum and then declines, although the peak elongation is achieved earlier than the peak yield strength. Thus, by the present step of artificially aging the strip by heating to an elevated temperature for a time shorter than that required to achieve peak yield strength (in contrast to the prior conventional practice of heating at least long enough to achieve peak yield strength), there is provided an advantageous combination of high strength and good formability: i.e. the relatively short heating time effects beneficial enhancement of yield strength (as compared to the yield strength in T3 temper) without undue impairment of % elongation (as compared to the elongation in T3 temper). Fully adequate enhancement of strength for such purposes as the fabrication of drawn-and-ironed cans can be achieved by artificial aging for a time such that the % elongation is within 20% of the maximum value attainable upon artificially aging the same strip at the same temperature. Indeed, preferably in many cases, the artificial aging time can be selected to provide an actual increase in % elongation (as compared to the % elongation of the strip in T3 temper, viz. just before artificial aging) as well as a satisfactory enhancement of yield strength. Other pertinent mechanical properties are also found to be at suitable levels (e.g. for can stock and other uses) in T8 strip after subjection to this duration of artificial aging.

Figure 2:
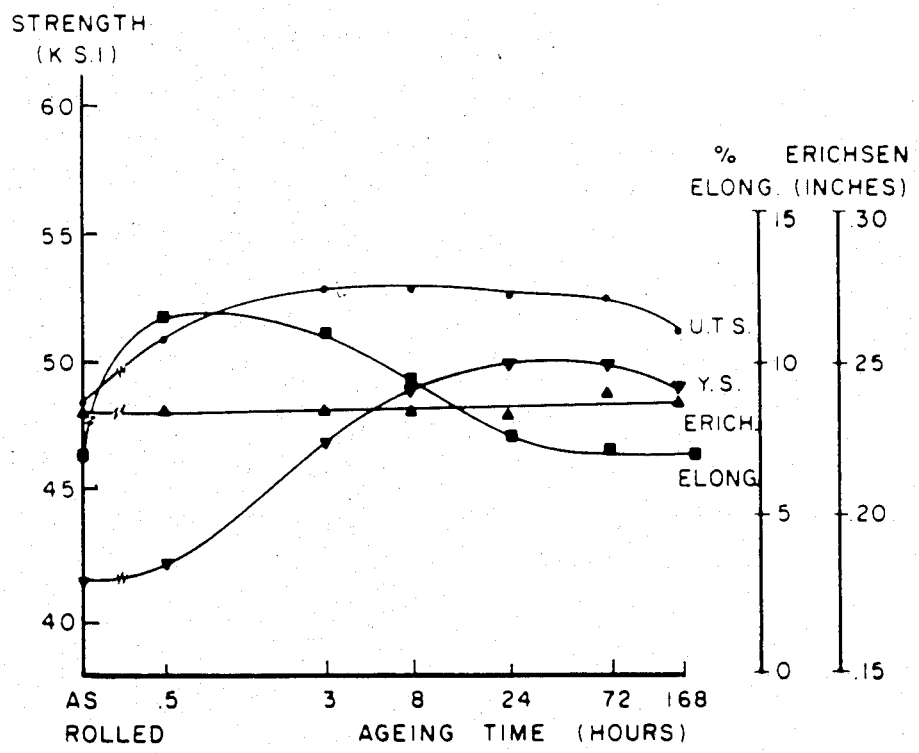
FIG. 2 is a rectangular graph of ultimate tensile strength (UTS), yield strength (YS), % elongation and Erichsen cup depths of artificially aged (T8 temper) AA6061 alloy sheet, plotted against artificial aging time, for sheet subjected to 35% cold reduction after solution heat treatment, to a final gauge of 0.030 inch, and then artificially aged at 160° C.
Figure 3:
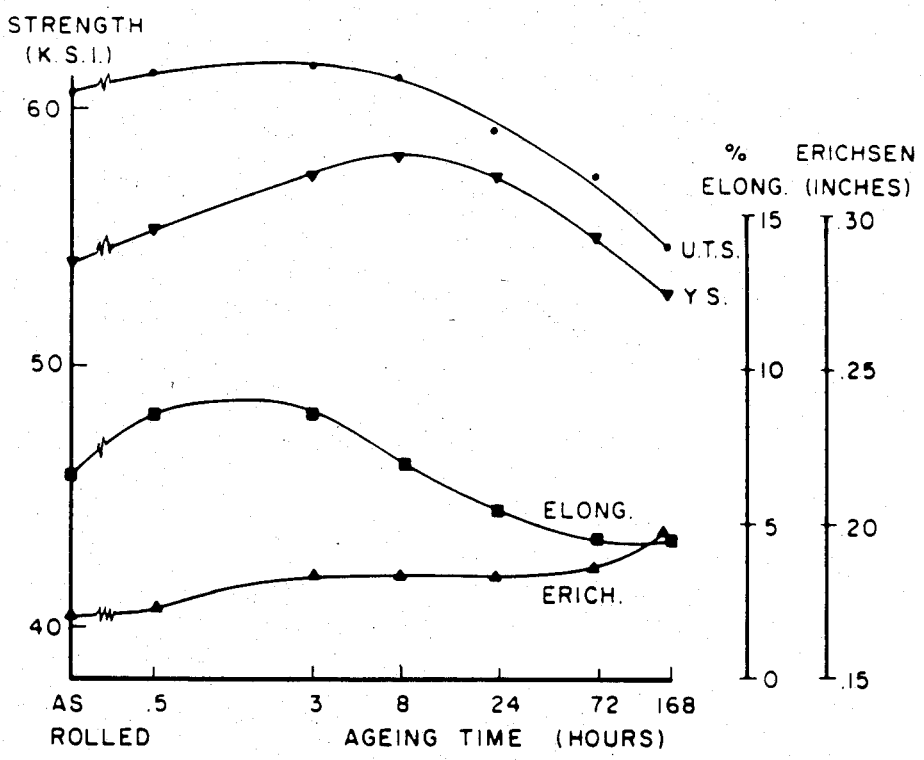
FIG. 3 is a graph similar to FIG. 2 for AA6061 (T8) sheet subjected to 71% cold reduction after solution heat treatment, to a final gauge of 0.0135 inch, and then artificially aged at 160° C.
Figure 4:
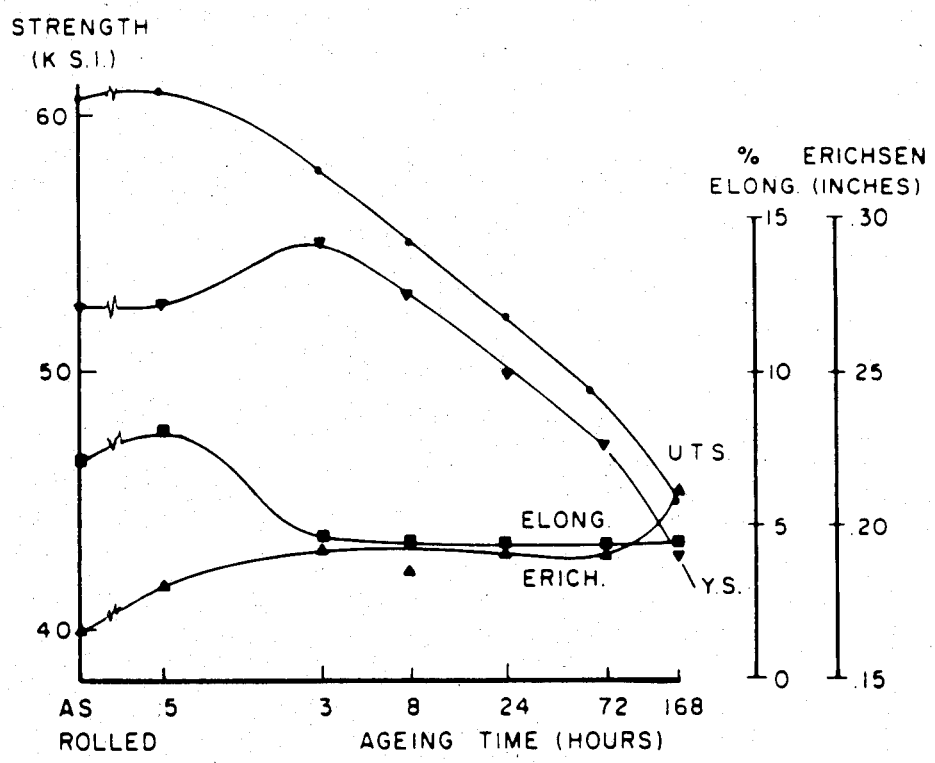
FIG. 4 is a graph similar to FIGS. 2 and 3 for AA6061 (T8) sheet subjected to 71% cold reduction after solution heat treatment, to a final gauge of 0.0135 inch, and then artificially aged at 185% C.

The relationship between aging time and yield strength and % elongation is illustrated, for exemplary treatments, in FIGS. 2–4. These figures show properties obtained upon artificial aging of strip of an AA 6061 alloy having the following composition: 0.26% Cu, 0.26% Fe, 0.89% Mg, 0.04% Mn, 0.64% Si, 0.027% Ti, 0.20% Cr, balance essentially aluminum. The strip was produced from a direct chill cast ingot which was homogenized, hot rolled and coiled at 0.13 in. (reroll gauge), cold rolled to an intermediate gauge of 0.046 in., and solution heat treated on a continuous annealing line (60 seconds, 570° C.). Thereafter, the strip was naturally aged at ambient temperature for at least one day, and cold rolled to final gauges of 0.030 in. (strip sample of FIG. 2) or 0.0135 in. (strip samples of FIGS. 3 and 4). The 0.030 in. final gauge strip sample was artificially aged at 160° C., different portions of the sample being thus heated for different times; the 0.0135 in. final gauge samples were artificially aged at 160° C. (FIG. 3) or 185° C. (FIG. 4), with different portions of these samples again being heated for different times. The curves shown in FIGS. 2–4 represent the values of the indicated properties, measured in the transverse direction, for the strip portions in T8 temper after various different artificial aging times. The values of properties indicated at 0 aging time ("as rolled") are the values measured for each sample in T3 temper, before artificial aging. For all aging times, strengths measured in a longitudinal direction are generally higher than the transverse values represented in the figures, but exhibit essentially the same dependence on heating time. These and other properties of the samples of FIGS. 2–4 are summarized in Table I.

TABLE I

| Sample | Artificial Aging Time | Tensile Properties Transverse UTS. (ksi) | Transverse YS. (ksi) | Transverse EL. (%) | Longitudinal UTS (ksi) | Longitudinal YS. (ksi) | Longitudinal EL. (%) | Erichsen Cup Height (in.) | Bendability, R/T Long. | Bendability, R/T Trans. |
|---|---|---|---|---|---|---|---|---|---|---|
| FIG. 2 (final gauge 0.030 in.; artificially aged at 160° C.) | 0 | 48.4 | 41.7 | 7.0 | 48.2 | 43.8 | 6.8 | 0.233 | 1.300 | 1.833 |
| | ½ hr. | 51.0 | 42.3 | 11.5 | 52.3 | 44.9 | 10.5 | 0.234 | 0.443 | 0.678 |
| | 3 hrs. | 53.1 | 46.8 | 11.0 | 54.4 | 48.9 | 11.0 | 0.233 | 1.313 | 1.300 |
| | 8 hrs. | 53.1 | 48.9 | 9.3 | 54.2 | 51.0 | 9.0 | 0.235 | 1.309 | 1.291 |
| | 1 day | 52.8 | 49.8 | 7.5 | 53.6 | 51.7 | 7.3 | 0.232 | 1.304 | 1.533 |
| | 3 days | 52.5 | 49.9 | 7.0 | 52.7 | 51.0 | 7.0 | 0.240 | — | — |
| | 7 days | 51.3 | 48.9 | 7.0 | 51.0 | 49.3 | 7.0 | 0.237 | — | — |
| FIG. 3 (final gauge 0.0135 in.; artificially aged at 160° C.) | 0 | 60.5 | 54.1 | 6.5 | 59.3 | 56.4 | 5.0 | 0.170 | 2.045 | 2.313 |
| | ½ hr. | 61.5 | 55.3 | 8.5 | 61.8 | 57.6 | 7.5 | 0.173 | 1.729 | 2.331 |
| | 3 hrs. | 61.7 | 57.3 | 8.5 | 62.3 | 59.0 | 7.5 | 0.183 | 1.729 | 2.045 |
| | 8 hrs. | 61.4 | 58.2 | 6.8 | 61.3 | 59.3 | 6.0 | 0.183 | 1.729 | 2.045 |
| | 1 day | 59.3 | 57.5 | 5.3 | 58.5 | 56.8 | 4.3 | 0.183 | 1.716 | 1.729 |
| | 3 days | 57.3 | 55.1 | 4.5 | 55.9 | 54.4 | 3.5 | 0.186 | — | — |
| | 7 days | 54.8 | 52.9 | 4.5 | 52.9 | 51.0 | 4.3 | 0.197 | — | — |
| FIG. 4 (final gauge 0.0135 in.; artificially aged at 185° C.) | 0 | 60.6 | 52.6 | 7.0 | 59.7 | 54.5 | 5.5 | 0.165 | — | — |
| | ½ hr. | 60.8 | 52.5 | 8.0 | 61.2 | 56.9 | 6.5 | 0.180 | — | — |
| | 4 hrs. | 57.8 | 55.0 | 4.5 | 56.3 | 54.6 | 3.3 | 0.193 | — | — |
| | 8 hrs. | 55.1 | 53.0 | 4.0 | 53.4 | 51.0 | 3.3 | 0.184 | — | — |
| | 1 day | 52.1 | 49.8 | 4.0 | 49.7 | 47.0 | 3.8 | 0.192 | — | — |
| | 3 days | 49.2 | 47.0 | 4.0 | 46.4 | 42.7 | 4.0 | 0.190 | — | — |
| | 7 days | 46.9 | 42.8 | 4.0 | 43.8 | 39.6 | 4.0 | 0.210 | — | — |

It will be seen that for each of the samples represented by FIGS. 2–4, both yield strength and % elongation exhibit an initial increase (compared to the T3 temper values) during artificial aging. As the aging (heating) treatment continues, elongation begins to decrease, while yield strength continues to increase for some further period before starting to decline. In each instance, it is possible to select a time at which the elongation is within 20% of its maximum value and yet the yield strength is greater than that of T3 temper, although this time varies depending on such factors as artificial aging temperature and % cold reduction (35% in FIG. 2; 71% in FIGS. 3 and 4) after solution heat treatment.

By way of specific example, for 0.013 in. gauge strip of AA 6061 alloy work hardened by cold reduction of 71% after solution heat treatment, an aging time of three hours at 160° C. (or a shorter aging time at a higher temperature) produces a significant increase in both % elongation and yield strength (as compared to the values in T3 temper) as well as achieving satisfactory levels of such other properties as Erichsen Cup height and ultimate tensile strength. More generally, the times to peak % elongation and peak yield strength during artificial aging are dependent on alloy composition; efficiency of solution heat treatment, as affected by time, temperature, quenching rate, and prior influence from homogenization treatment of the ingot (e.g., whether the homogenization treatment dissolved all coarse $Mg_2Si$); % of cold reduction following solution heat treatment; extent of natural aging, and whether natural aging precedes or follows the cold reduction after solution heat treatment; and aging temperature. The above factors, and also the final gauge, affect the magnitude of the peak % elongation during artificial aging. Accordingly, in the practice of the invention, the proper heating time for the artificial aging step is determined, after selection of the foregoing factors, by aging for different periods a series of samples of strip for which all these factors are held constant, thereby to establish the artificial aging time dependency of the yield strength and % elongation of such strip. An aging time at which suitable values of yield strength and % elongation are achieved can then be immediately determined, and employed as the artificial aging time for commercial production of the same strip. The procedure involved in thus establishing the aforementioned time dependency is simple and straightforward and can readily be practiced by persons of ordinary skill in the art.

Conveniently, the artificial aging step of the present process can be performed as a batch artificial aging treatment, by heating a coil of the strip at final gauge (and initially in T3 temper) to a temperature in the range of, say, 160° C. for a period of 1–3 hours. Alternatively, aging can be performed by stoving the T3 strip for a much shorter time at a substantially higher temperature, e.g., by stoving for about 10 to about 20 minutes at about 200° C. In particular instances, such a stoving step may also be used to perform some other function; for example, in the production of can lids, the stoving of the lid stock after lacquering can be performed under the just-mentioned conditions so as to constitute the artificial aging step of the present process. Again, in this rapid stoving treatment, the artificial aging step effects an increase in yield strength and provides a % elongation (in the artifically aged strip) within 20% of the maximum value attainable during stoving at the selected temperature, such value being commonly or preferably higher than the % elongation of the T3 temper strip before stoving.

The product of the present process, after completion of the artificial aging step, is a sheet article of Al-Mg-Si alloy in T8 temper, exhibiting a combination of high strength and good formability achieved by the above described succession of steps, in particular including the artificial aging step performed under the specified conditions of aging for a time less than that required to achieve peak yield strength. Such sheet may be produced in various final gauges, for a wide variety of differentend uses for which this combination of strength and formability properties is necessary or advantageous.

Production of Cans

In specific and presently preferred embodiments of the process of the invention as employed for the production of components of cans (viz. drawn-and-ironed can bodies or lids therefor), the final gauge of the T8 strip resulting from the practice of the above-described steps is selected to be appropriate for direct formation of can bodies (e.g. 0.014 inch final gauge strip) or lids (e.g. 0.013 inch final gauge strip), and the artificial aging treatment is followed by a step of forming the T8 strip into a one-piece can body or a can lid, in accordance with forming procedures now wholly conventional for forming such bodies and lids. Ordinarily the process in each instance (bodies and lids) will include a lacquering step, followed by stoving.

It is conventional, in the case of lids, to lacquer and stove the sheet stock from which the lid is made prior to the lid-forming operation. The lacquer in such case may be applied while the sheet is in T3 temper and as already stated, the subsequent stoving of the lacquered sheet may be performed under conditions (e.g. heating for about 10–20 minutes at about 200° C.) selected to effect the special artificial aging treatment of the invention. Thereafter, the lacquered and stoved (T8 temper) sheet is conventionally formed into can lids. Alternatively, the T3 temper sheet may first be artificially aged in accordance with the invention and subsequently lacquered, stoved, and formed into lids.

In the case of can body stock, the forming (drawing and ironing) operations precede lacquering and stoving, and the stock in final gauge is subjected to the artificial aging step of the invention before being formed into can bodies, i.e. the stoving after lacquering is a separate heat treatment performed subsequent to artificial aging. Where stoving after lacquering is performed as a separate treatment, it ordinarily occasions some reduction in strength, but causes relatively less strength reduction than is caused by stoving of AA 3004 lacquered cans.

The products of these embodiments of the present process are, respectively, a drawn-and-ironed can body and a can lid of Al-Mg-Si alloy having the beneficial properties developed by the combination of treatments described above. Most advantageously, a lid and body of the same alloy composition are produced and assembled to provide a can wherein both components (lid and body) are constituted of a single composition as desired to facilitate recycling and reuse of the metal.

The invention affords further important advantages, as well, for the production of can lids and bodies. Certain of these advantages will be apparentfrom the comparison of AA 6061 can stock prepared in accordance with the present process, and conventional AA 3004 and AA 5182 can body and lid stock, set forth in Table II wherein the AA 6061 stock at T8 temper (which is at a gauge of 0.013 inch) represents the product of the invention:

TABLE II

| Alloy (AA) | Temper | Treatment | Ultimate Tensile Strength (ksi) | Yield Strength (ksi) | Elongation (%) | Earing (%) | Erichsen Cup Height (in.) | Bendability (Min. R/T) |
|---|---|---|---|---|---|---|---|---|
| 6061 | T4 | nat. aged 1 week | 35 | 18 | 24 | — | — | — |
| 6061 | T3 | 50% cold work | 51 | 48 | 3 | — | — | — |
| 6061 | T8 | aged 3 hrs. at 160° C. | 57 | 53 | 9 | 2.5–3.0 | 0.190 | 1.0–1.5 |
| 6061 | T8 | lacquered | 55 | 51 | 8 | 2.5–3.0 | 0.190 | 1.0–1.5 |
| 3004 | H19 | as rolled | 42 | 39 | 3.0 | 2.5–3.5 | 0.195 | 2.0–3.0 |
| 3004 | H19 | lacquered | 37 | 34 | 4.5 | — | — | — |
| 5182 | H19 | as rolled | 60 | 58 | 3.0 | — | — | — |
| 5182 | H19 | lacquered | 54 | 44 | 8.5 | — | 0.175 | 1.0–1.5 |

The AA 6061 stock represented in the foregoing table was produced by successively direct chill casting and homogenizing an ingot, hot rolling, cold rolling to an intermediate gauge, solution-heat-treating and quenching, natural aging for at least one day, and cold rolling (with 50–71% reduction) to final gauge, followed by artificial aging, as indicated, for 3 hours at 160° C. The lacquering treatment referred to in the table followed artificial aging (in the case of the AA 6061 stock,) and in each instance involved stoving the lacquered metal at 195° C. for 10 minutes.

As is apparent from the table, the AA 6061-T8 strip produced by the invention has earing and Erichsen values comparable to conventional AA 3004 body stock, better bendability, and yield strength 14 k.s.i.

(thousands of pounds per square inch) higher than the AA 3004 body stock before lacquering; after lacquering, though yield strength falls in both instances, the yield strength differential is even greater (17 k.s.i.) in favor of the AA 6061-T8 stock. This lacquered strength is particularly important for can bodies as it directly affects the pressure at which the bottom of the filled can will buckle outwardly. Because of pasteurization after filling, a minimum bottom buckle pressure of 90 p.s.i. is commonly required for drawn-and-ironed can bodies. 3004-H19 can bodies generally develop buckle pressures between 95 and 110 p.s.i.; in one test, 6061-T8 can bodies were shown to develop bottom buckle pressures in excess of 130 p.s.i. Thus, 6061-T8 can body stock produced by the process of the invention may be reduced in gauge, as compared to 3004-H19 stock, with consequent reduction in metal cost per can, and still exceed buckle pressure requirements.

Compared to 5182-H19 can lid stock, lacquered 6061-T8 stock produced in accordance with the invention has higher yield strength (7 k.s.i. higher, in the example represented by the table), higher Erichsen cup values, and the same bendability, although the 6061-T8 stock may be slightly less formable than 5182-H19 stock under severe draw conditions, and the higher yield strength of 6061-T8 does not provide improved buckle pressure performance, owing to the higher work hardening rate of the 5182 alloy, which results in a strength equivalent to 6061 in the formed areas of the lid which actually control buckle performance. Nevertheless, as the comparison of properties in the table illustrates, the properties exhibited by the 6061-T8 sheet are fully adequate for use as both lid and body stock, and are generally equivalent to or better than the properties of the conventional alloys used for lids and bodies.

It is to be understood that the invention is not limited to the features and embodiments hereinabove specifically set forth but may be carried out in other ways without departure from its spirit.

We claim:

1. A process for producing aluminum alloy sheet of predetermined final gauge, comprising the steps of:

(a) providing a sheet article, at an intermediate gauge from which a reduction of between about 25% and about 71% is required to achieve said final gauge, of a heat-treatable Al-Mg-Si alloy having a major content of Al and a minor content of Mg and available Si such that on a rectangular graph of % Mg plotted against % available Si the point representing said minor content lies within the area of a pentagon defined by the coordinates 0.2% Si, 0.4% Mg; 0.2% Si, 0.9% Mg; 0.4% Si, 1.2% Mg; 1.2% Si, 1.2% Mg; and 1.2% Si, 0.4% Mg;

(b) solution-heat-treating the sheet article at said intermediate gauge by successively heating and quenching the article, for effecting at least substantially complete solution of the Mg and the Si therein;

(c) after quenching, and without intervening heat treatment, naturally aging the sheet article by maintaining the sheet article at ambient temperature for at least about one day;

(d) after natural aging, and without intervening heat treatment, cold rolling the sheet article to said final gauge; and (e) artificially aging the cold rolled sheet article at said final gauge for increasing the yield strength thereof by heating the article to a predetermined temperature, beginning at a time To, under conditions such that (i) achievement of the maximum yield strength attainable by artificial aging of said final gauge cold rolled sheet article at said temperature requires continuing the heating until a time $T_2$ later than $T_o$, and (ii) the maximum value of % elongation attainable by artificial aging of said final-gauge cold rolled sheet article at said temperature following the extent of cold reduction performed in step (d) would be achieved by continuing the heating until a time $T_1$ later than $T_o$ but earlier than $T_2$ and terminating the heating at $T_1$;

wherein the improvement comprises:

(f) continuing the heating in step (e) at least until $T_1$ and terminating the heating at a time prior to $T_2$ and such that the % elongation value of the article after artifical aging is within 20% of said maximum value of % elongation.

2. A process according to claim 1, wherein the available Si content of said alloy is in excess of that required to combine completely with the Mg content present as $Mg_2Si$.

3. A process according to claim 2, wherein the available Si content is greater, by an amount of at least 0.05% of the weight of said alloy, than that needed to combine completely with the Mg content of said alloy as aforesaid.

4. A process according to claim 3, wherein said alloy contains Fe, and wherein the Si content of said alloy is greater than that needed to combine completely with the Mg content of said alloy by an amount equal to at least 0.05% of the weight of said alloy plus at least about $\frac{1}{3}$ of the weight % of Fe present in said alloy.

5. A process according to claim 4, wherein the Mg content of said alloy is selected to provide a total $Mg_2Si$ content between about 1.35% and about 1.50%.

6. A process according to claim 1, wherein the natural aging step is performed by maintaining the sheet article at ambient temperature for at least about 3 days.

7. A process according to claim 1, wherein said intermediate gauge is such that a reduction of at least about 35% therefrom is required to achieve said final gauge.

8. A process according to claim 7, wherein said intermediate gauge is such that a reduction of atleast about 50% therefrom is required to achieve said final gauge.

9. A process according to claim 1, wherein the artificial aging step is performed by heating the article to a predetermined temperature for a time period such that the % elongation value of the article is greater than the % elongation value of the article immediately prior to the artificial aging step.

10. Aluminum alloy sheet produced by the process of claim 1.

11. A process according to claim 1, further including the step of forming the sheet article into a component of a can, said can consisting essentially of a one piece drawn and ironed body having an open end and a lid for closing the open end, said body and said lid being the components of said can.

12. A process according to claim 11, wherein said component is a can lid, wherein said sheet article, after rolling to said final gauge, is coated with lacquer and stoved under conditions selected to effect artificial aging of the article as aforesaid, and wherein the step of forming the sheet article into the lid is performed after stoving.

13. A process according to claim 11, wherein said component is a one-piece drawn and ironed can body, and wherein the step of forming the sheet article into the body is performed after said artificial aging step.

14. A can component produced by the process of claim 11.

15. A process according to claim 1, wherein said alloy consists essentially of about 0.2% to about 1.2% available Si, about 0.4% to about 1.2% Mg, up to 0.9% Cu, up to 1.0% Fe, up to 0.8% Mn, up to 0.35% Cr, up to 0.25% Zn, up to 0.20% Ti, balance Al.

16. A process for producing an aluminum alloy can consisting essentially of a one-piece drawn and ironed body having an open end, and a lid for closing the open end, said process comprising:

(a) preparing a first sheet article, in T3 temper, of a heat-treatable Al-Mg-Si alloy;

(b) preparing a second sheet article, in T3 temper, of the same Al-Mg-Si alloy;

(c) artificially aging each said sheet article for increasing the yield strength thereof by heating the article to a predetermined temperature, beginning at a time To, under conditions such that (i) achievement of the maximum yield strength attainable by artificial aging of the same article at said temperature requires continuing the heating until a time $T_2$ later than To, and (ii) the maximum value of % elongation attainable by artificial aging of the same article at said temperature would be achieved by continuing the heating until a time $T_1$ later than To but earlier than $T_2$ and terminating the heating at T1;

(d) continuing the heating in step (c) at least until $T_1$ and terminating the heating at a time prior to $T_2$ and such that the % elongation value of the article after artificial aging is within 20% of said maximum value of % elongation;

(e) forming one of said articles into a one piece drawn and ironed can body having an open end;

(f) forming the other of said articles into a lid for closing said open end; and (g) assembling said body and said lid to produce a closed can.

* * * * *